US008656518B2

(12) United States Patent
Saunders et al.

(10) Patent No.: US 8,656,518 B2
(45) Date of Patent: Feb. 25, 2014

(54) CHEMICAL RESISTANT GLOVE HAVING CUT RESISTANT PROPERTIES

(75) Inventors: Paul Saunders, Worcestershire (GB); Michael Flather, Worcestershire (GB); Dave Narasimhan, Flemington, NJ (US)

(73) Assignee: Ansell Healthcare Products LLC, Iselin, NJ (US)

( * ) Notice: Subject to any disclaimer, the term of this patent is extended or adjusted under 35 U.S.C. 154(b) by 841 days.

(21) Appl. No.: 12/194,755

(22) Filed: Aug. 20, 2008

(65) Prior Publication Data

US 2009/0077713 A1 Mar. 26, 2009

Related U.S. Application Data

(60) Provisional application No. 60/974,667, filed on Sep. 24, 2007.

(51) Int. Cl.
*A41D 19/00* (2006.01)

(52) U.S. Cl.
USPC ..... 2/161.6; 428/35.7

(58) Field of Classification Search
USPC ..... 2/16, 20, 21, 161.1, 161.6, 167, 168; 428/35.7, 36.1, 36.8; 427/2.1, 2.3, 427/207.1
See application file for complete search history.

(56) References Cited

U.S. PATENT DOCUMENTS

| | | | | |
|---|---|---|---|---|
| 2,083,684 | A | 6/1937 | Burke | |
| 4,283,244 | A | 8/1981 | Hashmi | |
| 4,514,460 | A | 4/1985 | Johnson | |
| 4,515,851 | A | 5/1985 | Johnson | |
| 4,555,813 | A | 12/1985 | Johnson | |
| 4,589,940 | A | 5/1986 | Johnson | |
| 4,847,918 | A | 7/1989 | Sturn | |
| 5,070,540 | A | 12/1991 | Bettcher et al. | |
| 5,564,127 | A * | 10/1996 | Manne | 2/161.7 |
| 5,581,812 | A | 12/1996 | Krocheski | |
| 5,822,791 | A | 10/1998 | Baris | |
| 5,822,795 | A | 10/1998 | Gold | |
| 6,081,927 | A * | 7/2000 | Gimbel | 2/161.7 |
| 6,495,612 | B1 * | 12/2002 | Corzani et al. | 523/105 |
| 6,539,522 | B1 | 3/2003 | Devins et al. | |
| 6,543,059 | B2 | 4/2003 | Szczesuil et al. | |
| 6,596,345 | B2 | 7/2003 | Szczesuil et al. | |
| 7,007,308 | B1 | 3/2006 | Howland et al. | |
| 7,814,571 | B2 * | 10/2010 | Thompson et al. | 2/161.6 |
| 2005/0035493 | A1 | 2/2005 | Flather et al. | |

(Continued)

OTHER PUBLICATIONS

"PCT International Search Report and Written Opinion", (Nov. 24, 2008), 9 pp.

*Primary Examiner* — Katherine Moran
(74) *Attorney, Agent, or Firm* — Moser Taboada

(57) ABSTRACT

A cut resistant chemical handling glove that is flexible and lightweight comprises a cured, liquid-impervious polymeric latex shell. A tacky acrylic adhesive with low shear strength can be used. A cut resistant liner is slipped on the tacky adhesive coating and is infiltrated with a polymeric latex coating and cured to integrally attach the cut resistant liner with the cured polymeric coating. When the latex glove is worn on a hand and a cutting edge, such as a knife edge, contacts the glove, a crease is formed due to slip at the tacky adhesive-cut resistant liner interface creating a geometry that reduces cut stress intensity at the knife-edge thereby increasing the cut resistance of the glove. Processes for making and using these gloves are also described.

20 Claims, 8 Drawing Sheets

(56) References Cited

U.S. PATENT DOCUMENTS

2006/0059604 A1* 3/2006 Lai et al. ..... 2/168
2006/0068140 A1 3/2006 Flather et al.
2006/0150299 A1* 7/2006 Geng ..... 2/161.6
2006/0150300 A1 7/2006 Hassan et al.
2008/0263738 A1* 10/2008 Shamis et al. ..... 2/16

* cited by examiner

Sample mounted on standard steel mandrel.

| | | | |
|---|---|---|---|
| Sample Thickness (mm) | | 1.78 | |
| Sample Type | | Coated Knit | |
| Temperature © | | 20 | |
| Relative Humidity (%) | | 65 | |
| Cut Number | Load (g) | Distance (mm) | Normalized Distance (mm) |
| 1 | 3600 | 7.38 | 5.64 |
| 2 | 3600 | 7.56 | 5.78 |
| 3 | 3600 | 7.82 | 5.98 |
| 4 | 3600 | 7.12 | 5.44 |
| 5 | 3600 | 7.50 | 5.73 |
| 6 | 3400 | 8.31 | 6.35 |
| 7 | 3400 | 7.94 | 6.07 |
| 8 | 3400 | 8.22 | 6.28 |
| 9 | 3400 | 8.36 | 6.39 |
| 10 | 3400 | 7.56 | 5.78 |
| 11 | 3200 | 10.93 | 8.36 |
| 12 | 3200 | 17.58 | 13.44 |
| 13 | 3200 | 13.27 | 10.15 |
| 14 | 3200 | 10.47 | 8.00 |
| 15 | 3200 | 11.19 | 8.56 |

Sample mounted over 0.25 in Sorbothane substrate.

| | | | |
|---|---|---|---|
| Sample Thickness (mm) | | 1.78 | |
| Sample Type | | Coated Knit | |
| Temperature © | | 20 | |
| Relative Humidity (%) | | 65 | |
| Cut Number | Load (g) | Distance (mm) | Normalized Distance (mm) |
| 1 | 4800 | 48.19 | 36.84 |
| 2 | 5000 | 39.10 | 24.39 |
| 3 | 5000 | 47.60 | 36.39 |
| 4 | 5200 | 47.22 | 36.10 |
| 5 | 5200 | 40.46 | 30.93 |
| 6 | 5600 | 34.50 | 26.38 |
| 7 | 5600 | 25.29 | 19.33 |

CHEMICAL RESISTANT GLOVE HAVING CUT RESISTANT PROPERTIES

CROSS-REFERENCE TO RELATED APPLICATIONS

This application claims priority under 35 U.S.C. §119(e) to U.S. Patent Application Ser. No. 60/974,667, filed Sep. 24, 2007, which is hereby incorporated by reference in its entirety.

TECHNICAL FIELD

This invention relates to a chemical resistant latex glove article with cut resistant properties having a chemically resistant polymeric inner shell covering the front, back and the forearm and the polymeric shell being adhesively tacked to a cut resistant liner which is integrally embedded in a polymeric coating, and methods of making and using the same.

BACKGROUND

Polymeric shells, including unsupported medical, surgical and other gloves, are typically made of latex. These polymeric shells are produced in an assembly line fashion by dipping a coagulant-coated former of desired shape into an aqueous latex emulsion, thereby coagulating the latex. The coagulated layer is subsequently cured to form the polymeric shell. The aqueous latex emulsion may comprise additives, including viscosity modifiers, waxes, surfactants, stabilizers, cross-linking agents and the like, to produce a cured latex product having specific characteristics, such as thickness, tensile strength, tear and penetration resistance, flexibility; etc., in a controlled manner. Aqueous latexes of different compositions are known in the art, and they include natural rubber latexes, synthetic polyisoprenes, and other synthetic latexes, including neoprene, nitrile compositions, and the like. Examples of polymeric shells made from a typical aqueous dipping process are described in U.S. Pat. No. 3,268,647 to Hayes et al., which discloses the manufacture of rubber gloves. Nitrile latex gloves are commonly used to provide chemical resistance.

Supported polymeric shells with a liner are known in the art and are commonly used in industrial environments, such as in the form of gloves for protecting hands, where use of a strong latex product is needed. A number of patents disclose coating the liner with a latex composition. For example, U.S. Pat. No. 2,083,684 to Burke discloses rubber-coated gloves and a method of making the same. U.S. Pat. Nos. 4,514,460; 4,515,851; 4,555,813; and 4,589,940 to Johnson disclose slip-resistant gloves and a method for their manufacture. U.S. Pat. No. 5,581,812 to Krocheski discloses a leak-proof textile glove. The inner surface of a cut-resistant textile layer is bonded to a leak-proof, petroleum-resistant, polymeric material, such as PVC, without an intervening adhesive layer, since the leak-proof polymeric material is applied to a liner placed on a former. U.S. Pat. No. 5,822,791 to Baris discloses a protective material and a method wherein a cut-resistant, protective layer is coated with an impervious elastomeric material.

A typical process for producing these supported gloves includes the use of a liner, which is dressed over a former, optionally treated with a coagulant, and dipped into an aqueous latex emulsion to form a gelled latex layer over the liner, which is then cured. The penetration of the aqueous latex emulsion into the dressed liner results in "strike-through," or "penetration," which creates an unsightly appearance of the supported product, discomfort on the bare hand, and makes the article more rigid and less flexible. A number of steps are taken to minimize "strike-through," including coagulant coating of the liner as a blocking agent, and increasing the viscosity of the aqueous latex emulsion to prevent the penetration of the aqueous emulsion into the liner. The aqueous latex emulsion used may comprise several additives, such as stabilizers, foaming agents, cross-linking agents, waxes, and surfactants. The latex composition may be natural rubber, polyisoprene, polychloroprene, nitrile rubber, and the like. These supported polymeric shell products provide sufficient protection to the hands of the wearer. The dipping and drying of a glove former in a latex emulsion to form a glove is disclosed. However, the chemical resistance of the polymeric shell is generally inadequate due to poor coverage of the latex emulsion over the liner and may have holes in the latex layer where the fibers of the liner cross. A further and perhaps more serious consequence of coating over a knitted fabric is the possibility that the resultant polymeric film is compromised, resulting in a non-uniform thickness, which may compromise the chemical-resistant barrier of the film in parts or which may not be liquid-proof. This is due to the potential of surface fibers passing into or through the coating, hence providing an easier path for liquids to pass or permeate through the polymeric film. Foamed latex layers may have interconnected porosity, which also may provide decreased chemical resistance to the supported polymeric shell latex article.

U.S. Pat. No. 4,283,244 to Hashmi discloses a method of making fabric-lined articles. This method of making a lined elastomeric article comprises the steps of applying a coating of adhesive in a liquid state to an elastomeric article on a form, drying the adhesive on the article to form a pressure-sensitive adhesive coating, treating the adhesive coating with a lubricant, and thereafter applying a preformed lining over the article and the adhesive coating to connect adhesively the lining to the elastomeric article. The elastomeric article is a latex product produced by dipping a coagulant-treated former into an aqueous latex emulsion and drying and curing the elastomeric article on the former. The adhesive is 68096-01 resin supplied by Evans Adhesives of Columbus, Ohio, suspended in water. The elastomeric article on the former is dipped in the adhesive, dried to form a pressure-sensitive adhesive coating, lubricated, and dressed with a liner. The lined elastomeric article is removed from the former and turned inside-out. Unfortunately, sweating combined with body temperature results in the extraction or dissolution of the adhesive, producing an unpleasant skin feel. The adhesive also is soft, has low strength properties, and stays tacky even after drying.

U.S. Pat. No. 4,847,918 to Sturm discloses a protective hand covering and method of manufacture. This flexible fire-retardant and heat insulating fabric inner glove is mounted within and cemented to a flexible, watertight, vapor-permeable plastic glove using adhesive cement applied to the fabric liner and the plastic glove. Flexible tear resistant reinforcement is secured at the fingertips of the fabric inner glove and the plastic glove using a hot melt adhesive. The reinforcement is not indicated to be cut resistant and is not completely secured to an elastomeric material.

U.S. Pat. No. 5,070,540 to Bettcher et al. discloses a protective garment having a cover, a fabric liner, and a coating of elastomeric material permeating the cover and adhering the liner and cover together. The fabric liner is in a skin-contacting region. The cover is cut resistant with wire strands. The cover can be knit from yarn that has a core having 2 to 6 strands of stainless steel wire and a parallel synthetic polymer fiber strand, and the core can be wrapped with strands of non-aramid fiber in opposite directions one on top of the other. The elastomeric material can be formed from nitrile latex, which is said to infiltrate the cut resistant cover, but does not infiltrate through the fabric liner, yet infiltrates sufficiently to adhere the liner to the cover. Such precision of latex dipping, however, is not readily realized in industrial practice.

U.S. Pat. No. 5,822,795 to Gold discloses multi-layer glove constructions and methods of constructing multi-layer gloves. This multi-layer glove incorporates an inner liner, intermediate waterproof, windproof and/or breathable membrane layer and an outer shell. The membrane layer is secured to the inner layer and the outer layer by adhesive tapes to provide secure fit between the layers and inhibits the reversibility of layers when the hand is removed from the glove. The crotch region is also inhibited from movement by the membrane layer during use. The multi-layered glove is also assembled more efficiently with improved construction techniques relating to the use of the adhesive strips secured to the outside of the inner liner layer. The multi-layer glove does not have a cut resistant liner and is not indicated to provide chemical resistance and protection.

U.S. Pat. Nos. 6,543,059 and 6,596,345 to Szczesuil et al. disclose a protective glove and a method for making same. This protective glove for a human hand includes an inner glove of polyester, non-woven, needle-punched material and a melt-sprayed polyurethane coating. This non-woven needle-punched material has no mechanical integrity, unlike a woven or knitted fabric and the hot melt-sprayed polyurethane adhesive holds the configuration together forming a glove. The melt-sprayed glove is heated to a temperature of 300 to 325° F. to allow the remelted polyurethane to penetrate the inner glove to a depth short of penetrating to the inner surface of the inner glove. The polyurethane coating on the outer surface of the inner glove cures in approximately 24 hours by reaction with ambient moisture. The inner glove is further coated with a rubberized material to produce an inner glove held together by the rubber, which is then cut to pieces and sewn, to form a glove with internal sewn seams. Such a glove is not liquid-impervious, since these sewn seams are not bonded and leak. Such a glove is liquid-impervious, therefore, not chemically resistant. The protective glove is said to protect from puncture, but the polyester non-woven inner glove will not provide cut resistance.

U.S. Pat. No. 6,539,552 to Yoshida discloses a flexible waterproof glove. This waterproof glove is formed of a flexible inner glove body of a base fabric that is thermally bonded with a low melting thermal plastic resin film and a flexible outer glove body of the same fabric. The thermal bonding of the inner glove with the outer glove is accomplished by heating the glove to melt the low melting thermal plastic resin film, which has a lower melting point than that of the base fabric. The melted thermal plastic resin film results in a watertight glove. The thumb portion of the glove is manufactured separately and bonded to the rest of the glove to provide improved thumb movement. The molten and solidified plastic resin film bonded to both inner and outer glove body results in a watertight glove. The overall rigidity and resistance to movement of the glove is exemplified by the need to attach the thumb component of the glove separately. There is no latex or polymeric shell in this glove. Thus, this glove has no stretch characteristics resembling those that are commonly available in a latex-based glove product.

U.S. Pat. No. 7,007,308 to Howland et al. discloses protective garment and glove construction and method for making same. The garment or glove has a cut and puncture resistant protective liner or multiple liners affixed to the inside shell or outside shell of the garment or glove by means of adhesives or stitching. The cut resistant protective liner may be attached to the outer surface of the inside shell by an adhesive layer. Alternatively, the cut resistant liner may be attached to the inside surface of the outside shell by an adhesive layer. When both inside shell and outside shell are present, the cut resistant liner is only attached to the inside shell by an adhesive layer as shown in FIG. 7. The adhesive is not indicated to be tacky or pressure sensitive. The cut resistant liner is not integrally attached to either the inside shell or the outside shell.

U.S. Pat. Appln. Pub. No. 2006/0068140 to Flather et al. discloses a polymeric shell adherently supported by a liner and a method of manufacture. The liquid-impervious polymeric shell is attached to a liner, which may be cut resistant, by use of a non-tacky thermoplastic adhesive applied by hot melting spraying and melting the adhesive to create a bond between the polymeric shell and the liner. A second polymeric shell may be attached to the liner by the application of non-tacky hot melt adhesive. The adhesive used is non-tacky and is solid at room temperature creating a rigid bond between the liner and the liquid-impervious polymeric shell.

Therefore, there is a need in the art for a latex glove article with a chemically resistant polymeric shell that is soft and flexible that covers the entire hand and wrist while at the same time, the chemically resistant polymeric shell is protected from knife or other sharp object damage. Any damage to the chemically resistant polymeric shell is not easily detected by the user and exposes the user to chemicals that may have severe consequences. The glove needs to be flexible and easy to use in industrial and laboratory environment. There is also a need in the art for a reliable manufacturing process that produces a chemical resistant full coverage glove wherein the chemical resistant polymeric shell is protected by knife or other damage while at the same time providing high level of flexibility. These and other objects and advantages, as well as additional inventive features, will be apparent from the detailed description provided herein.

BRIEF SUMMARY

Provided are cut resistant chemical handling latex gloves and methods of making and using the same. These gloves are flexible and lightweight. To a cured, liquid-impervious polymeric latex shell, a tacky adhesive coating with low shear strength is applied. A cut resistant liner is slipped on the tacky adhesive coating and is infiltrated with a polymeric latex coating and cured to integrally attach the cut resistant liner with the cured polymeric coating. When the latex glove is worn on a hand and a cutting edge, such as a knife edge, contacts the glove, a crease is formed due to slip at the tacky adhesive-cut resistant liner interface creating a geometry that reduces cut stress intensity at the knife-edge thereby increasing the cut resistance of the glove.

In one or more embodiments, provided is a latex glove comprising a cured, liquid-impervious chemical resistant nitrile or polychloroprene polymeric shell substantially free from defects; at least one cut resistant liner comprising cut resistant strand; a tacky pressure sensitive continuous adhesive layer placed between the shell and the cut resistant liner; and a polymeric coating having a thickness penetrating the interstices of the cut resistant liner that integrally encases the cut resistant liner and may extend beyond the liner surface distal from the tacky adhesive layer. When the glove is worn, with the liquid-impervious chemical resistant polymeric shell being proximate to the hand, and a knife contacts the polymeric coating, the interface between the cut resistant liner integrally encased in the polymeric coating and the tacky adhesive layer behaves as a slip interface creating a crease that increases the contact area between the cut resistant liner and the knife edge thereby reducing the overall stress intensity at the cutting edge. As a result, a much larger force is needed to create a cut in the glove article. The integrity of the liquid-impervious chemical resistant polymeric shell is maintained to a greater extent than a cut resistant liner that integrally attached to a polymeric shell and has no slip interface and taut cut resistant liner experiences higher stress level at the cutting edge creating a cut at a lower knife edge force.

Methods are provided that comprise forming a cured, liquid-impervious polymeric latex shell; coating the polymeric shell with a tacky adhesive coating; forming a lubricating surface by temporarily rendering the tacky adhesive coating not tacky; placing a cut resistant liner over the lubricating surface; restoring tackiness to the lubricating surface to provide the tacky adhesive coating; forming an integral cut resistant liner by infiltrating the cut resistant liner with a polymeric coating; anchoring the integral cut resistant linter to the tacky adhesive; and thereby forming the glove, which upon placing the glove on a hand and contacting a cutting edge on the glove, the integral cut resistant liner slips on the tacky adhesive, thereby reducing cutting stress at the cutting edge.

In one or more embodiments, methods for the manufacture of a cut resistant chemically protective latex article comprise providing a soft liquid-impervious chemical resistant nitrile or polychloroprene polymeric shell typically having a thickness in the range of 9 to 13 mils, covering the hands and forearm of a user in a so-called gauntlet configuration, that is coated with a tacky adhesive coating typically having a thickness in the range of 1 to 5 mil, slipping a cut resistant liner typically in the range of 15 to 30 mil slipped over the tacky adhesive layer, and forming a dipped polymeric coating having a thickness in the range of 15 to 35 mil that encapsulates the cut resistant liner and extends beyond the liner. The overall thickness of the latex glove article is in the range of 50 to 75 mils and is extremely soft and flexible in spite of its thickness due to compliance provided by the tacky adhesive layer contacting the cut resistant liner that is integrally attached to the polymeric coating. The method can comprise providing a cured, liquid-impervious, nitrile or polychloroprene polymeric shell produced by dipping a coagulant-coated former into an aqueous latex emulsion, coagulating a latex layer on the former, and heating the coagulated latex layer on the former to crosslink and cure the latex layer. The method can further comprise providing a continuous tacky styrene acrylic adhesive coating on the outer surface of the polymeric shell that is distal from the skin contacting surface by dipping the liquid-impervious nitrile or polychloroprene polymeric shell on the former in a water-based styrene acrylic solution and drying to form the tacky coating. The method further comprises wetting the tacky adhesive outer surface to disable the tackiness and dressing or inserting a cut resistant liner over the adhesive layer to form a polymeric shell assembly. Drying the polymeric shell assembly restores adhesive tackiness and fixes the attachment of the cut resistant liner to the tacky adhesive layer. In one or more embodiments, this polymeric shell assembly is coated first with a coagulant and dipped into a bath of nitrile or polychloroprene aqueous emulsion producing a polymeric coating that encapsulates the cut resistant liner. The polymeric coating may extend beyond the cut resistant liner, but does not reach or penetrate the tacky adhesive coating, it may, however, reach the tacky adhesive layer-cut resistant liner interface. The polymeric coating of nitrile or neoprene latex is thermally cured. Further aspects include methods of providing improved hand safety, the methods comprising: donning a cut resistant and chemical resistant latex glove, the glove comprising a cured, liquid-impervious polymeric latex shell, said polymeric shell coated with a tacky adhesive coating; and a coated cut resistant liner in contact with said tacky adhesive coating, the coated cut resistant liner comprising a cut resistant liner infiltrated with a polymeric coating; and applying a loading from a cutting edge to the glove such that the coated cut resistant liner slips on the tacky adhesive and thereby reduces cutting stress at the cutting edge.

DETAILED DESCRIPTION

Figure 1:
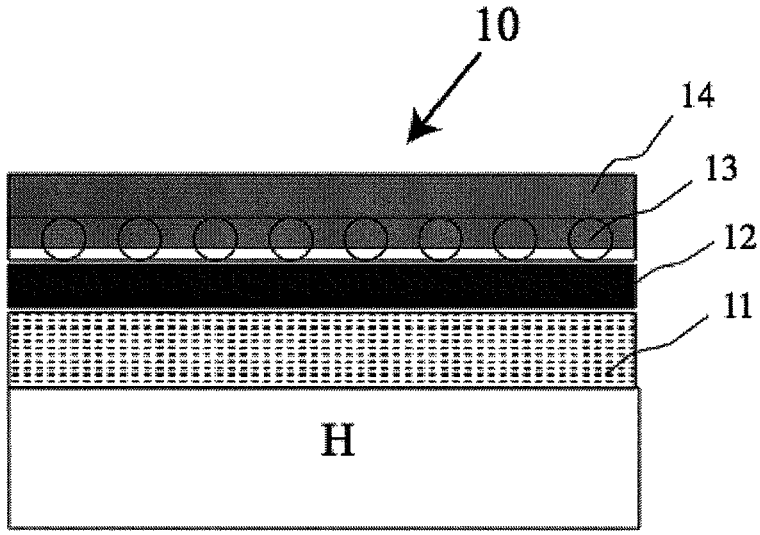
FIG. 1 illustrates a fragmentary cross-sectional view of the cut resistant latex glove article according to subject invention having a liquid-impervious chemical resistant nitrile or polychloroprene latex polymeric shell with a tacky adhesive coating anchoring a cut resistant liner that has been infiltrated with a polymeric coating that integrally attaches the polymeric coating to the cut resistant liner while the tacky adhesive liner acts as a slip interface.

Provided are cut resistant chemical handling latex gloves and methods of making and using the same. In one or more embodiments, provided is a latex glove article comprising a cured, liquid-impervious chemical resistant polymeric shell substantially free from defects, a tacky adhesive layer on the surface of the polymeric shell distal from the hand contacting surface, a cut resistant liner that has been encased in a polymeric coating integrally connecting the cut resistant liner with the polymeric coating. This geometrical arrangement of the glove is depicted in the FIG. 1 at 10, which represents the cross-section of the glove. Hand of the user is located at H and 11 is the liquid-impervious chemical resistant nitrile polymeric shell, which is typically 9 to 13 mil thick. A tacky adhesive layer 12 is coated on the polymeric shell surface distal from the user's hand H. Due to its tacky nature, fibers of a cut resistant liner 13 readily attach to the tacky adhesive, but the shear strength at the tacky adhesive interface is low and therefore, the cut resistant liner can slip under an applied loading such as that exerted by a knife-edge. In order for this slip to be reliable and predictable, the cut resistant liner needs to be supported by a polymeric coating 14 that seeps through the interstices of the cut resistant liner and encases the cut resistant fibers of the liner. Thus, when the latex glove article composite wall is bent at a sharp radius, the increase in length at the tensile side of the glove is accommodated by slippage at the tacky adhesive-cut resistant liner interface. When the latex glove article is brought back to a straightened condition, the layers move back close to their original position.

Figure 2:
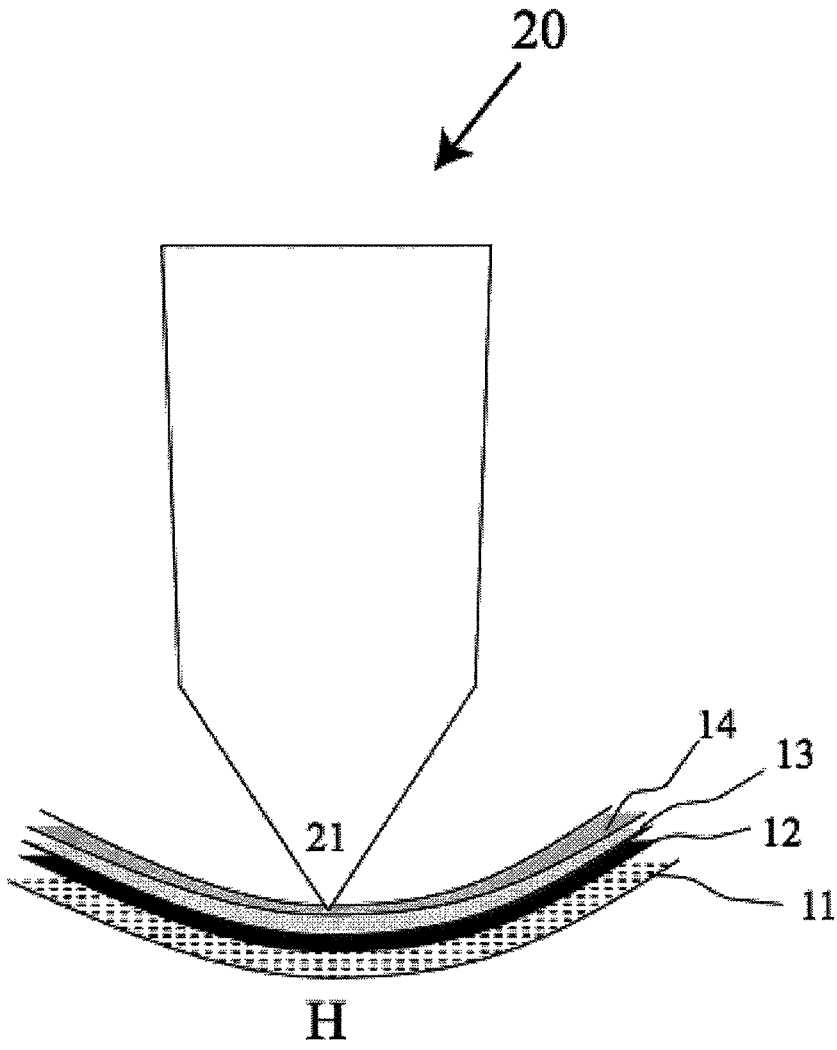
FIG. 2 illustrates a fragmentary cross-sectional view of the latex article of FIG. 1 placed on a compliant substrate such as a hand with the interior surface of the liquid-impervious chemical resistant polymeric shell contracting the hand and a knife contacting the polymeric coating resulting in slip of cut resistant liner on the tacky adhesive coating reducing stress intensity at the knife edge.

FIG. 2 at 20 depicts the movement of the slip interface between the tacky adhesive layer 12 and the cut resistance liner 13 encapsulated in a polymeric coating 14 contacts a knife edge 21, when the cut resistant latex article is worn on a human hand H. The polymeric coating 14 together with the integral cut resistant liner 13 form a crease and slides over the tacky adhesive layer 12 creating a larger length of the liquid-impervious chemical resistant polymeric shell 11 at the tension side, which is accommodated by the deformation of the hand portion H. This crease effectively creates a larger contact area of the cut resistant liner with the knife thereby decreasing the cutting stress intensity experienced by the liner. As a result, higher force on the knife is needed to create a cut of the cut resistant liner and the liquid-impervious chemical resistant polymeric shell is protected from damage preventing chemical exposure of the user. This increased cut resistance is accomplished without adding additional cut resistant liners to the glove and bonding them, which only makes the glove heavy, bulk and lack flexibility. On the other hand, the latex glove article of the present invention uses a single cut resistant liner integrally attached to a polymeric coating that slides under load on a tacky coating applied to a liquid-impervious chemical resistant polymeric shell providing a light weight glove with high flexibility and soft feel.

Figure 3:
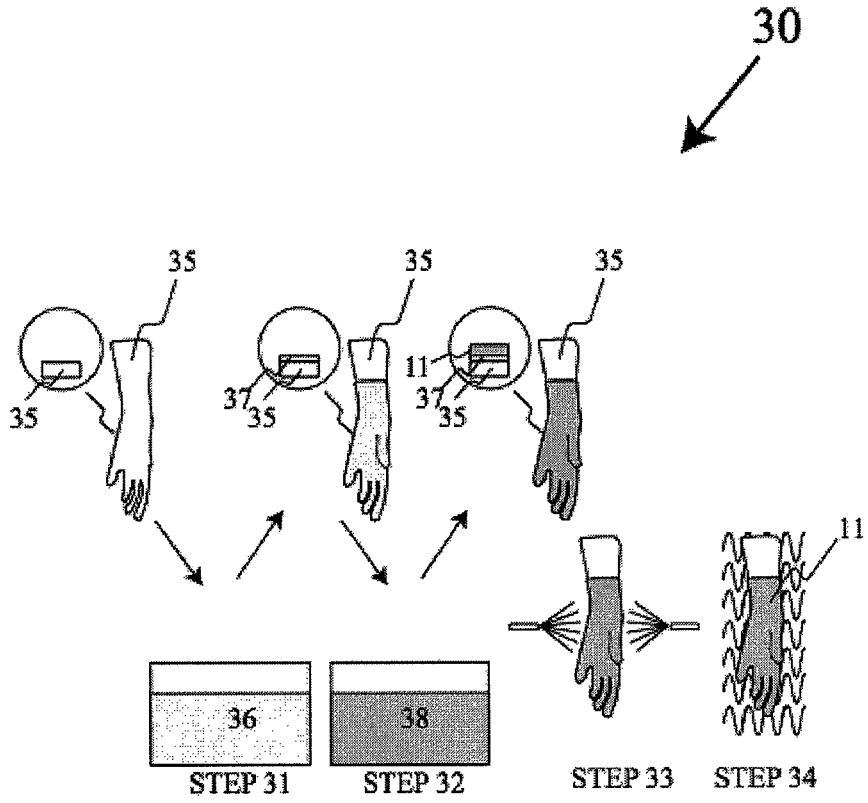
FIG. 3 illustrates the steps involved in producing a liquid-impervious chemical resistant nitrile or polychloroprene polymeric shell.

The polymeric shell needs to be liquid-impermeable so that the resultant article is chemically resistant. The polymeric shell generally comprises a synthetic latex, such as nitrile latex or polychloroprene latex, due to its high degree of soft feel. Nitrile latex has a low modulus and therefore feels soft on the hand and larger thickness gloves can be made with a comfortable feel. The thickness of the nitrile latex or polychloroprene latex in the gauntlet form that covers the user's hand and forearm completely is typically in the range of 9 mil to 13 mil. A schematic diagram representing the manufacturing process for the liquid-impervious chemical resistant nitrile or polychloroprene latex polymeric shell is shown in FIG. 3 at 30. In step 31 a ceramic or metallic former 35 in the shape of a human hand and forearm is dipped in a coagulant solution 36, which is typically calcium nitrate and forms film 37. In step 32, the coagulant coated former is dipped into a nitrile aqueous latex emulsion tank 38 and the coagulant locally destabilizes the nitrile or polychloroprene latex emulsion forming a nitrile or polychloroprene latex layer 11 on the former. A nitrile latex emulsion typically is water based and contains a base nitrile latex in an amount of approximately 100 phr, a cross linking agent such as sulphur in an amount of approximately 0.5 phr, an accelerator such as zinc oxide in an amount of approximately 3.0 phr, an accelerator such as ZMBT in an amount of approximately 0.7 phr, and surfactants such as sodium or calcium dodecylbenzenesulphonate, emulsion stabilizers, and viscosity moderators. This process may be repeated until a sufficient nitrile or polychloroprene latex layer is built up on the former. The former with the nitrile latex layer is washed in step 33, and cured in step 34 to cross link the nitrile latex polymeric shell 11. The inner surface of the polymeric shell may be optionally coated with cotton flock to produce a soft sweat-absorbing surface that contacts the hand of the user using known methods.

Figure 4:
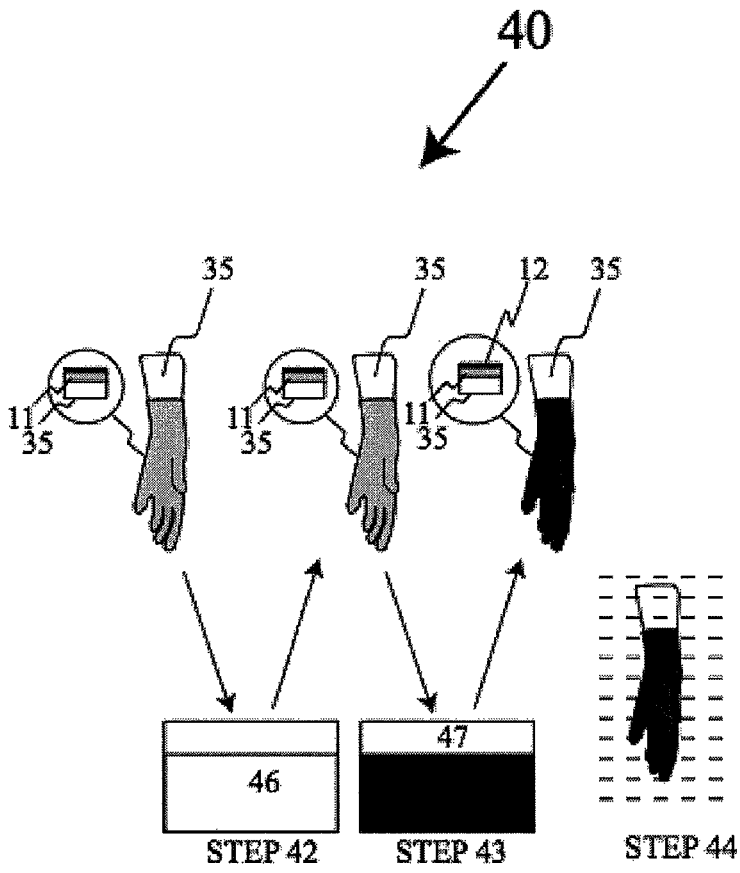
FIG. 4 illustrates the steps involved in producing a continuous tacky adhesive coating on the outer surface of the impervious chemical resistant nitrile or polychloroprene polymeric shell.

FIG. 4 schematically depicts at 40 the process of creating a tacky adhesive layer on the external surface of the nitrile or polychloroprene latex polymeric shell. The cured polymeric shell made from nitrile latex or polychloroprene latex is mounted over a glazed or polished former of the exact shape and size at step 34 of FIG. 3. The interior hand contacting surface of the polymeric shell contacts the glazed polished former. The mounted glove is rinsed in water in step 42. This step may be an immersion in a water tank 46 or simply a water spray may be used. The function of the water immersion or spray is to remove surface soaps predominantly Sodium dodecylbenzenesulphonate present from the earlier dipping of the former into latex emulsion in step 32 of FIG. 3 to produce cured polymeric latex shell. These soaps inhibit adhesive "wetting" or wet out and prevent uniform coating of the tacky adhesive coating on the external surface of the polymeric shell. The polymeric latex shell mounted on the former is dried in step 43 to remove all the water present and may be done conveniently with high velocity airflow at ambient temperature. The polymeric latex shell 11 mounted on the former 35 is dipped into a water based, pressure sensitive adhesive in step 44. The pressure sensitive adhesive used is a BASF product marketed under the trade name ACRONAL V210 STYRENE ACRYLIC polymer. The as received solution has a total solid content of approximately 40-70%. The as received solution is diluted with demineralized water to bring down the total solids content in the 40 to 50% range and the rheology of the solution is modified with 1% an ammonium polyacrylate for improve tacky adhesive coating. Adjusting the viscosity, total solid condition and withdrawal rate of the polymeric latex shell typically at one centimeter per second ensures correct coating weight of tacky adhesive and its uniform distribution on the exterior surface of the polymeric shell. In step 45, the tacky coating 12 is dried in high velocity airflow at ambient temperature. The tacky adhesive layer produced has a thickness in the range of 1 to 5 mils.

Figure 5:
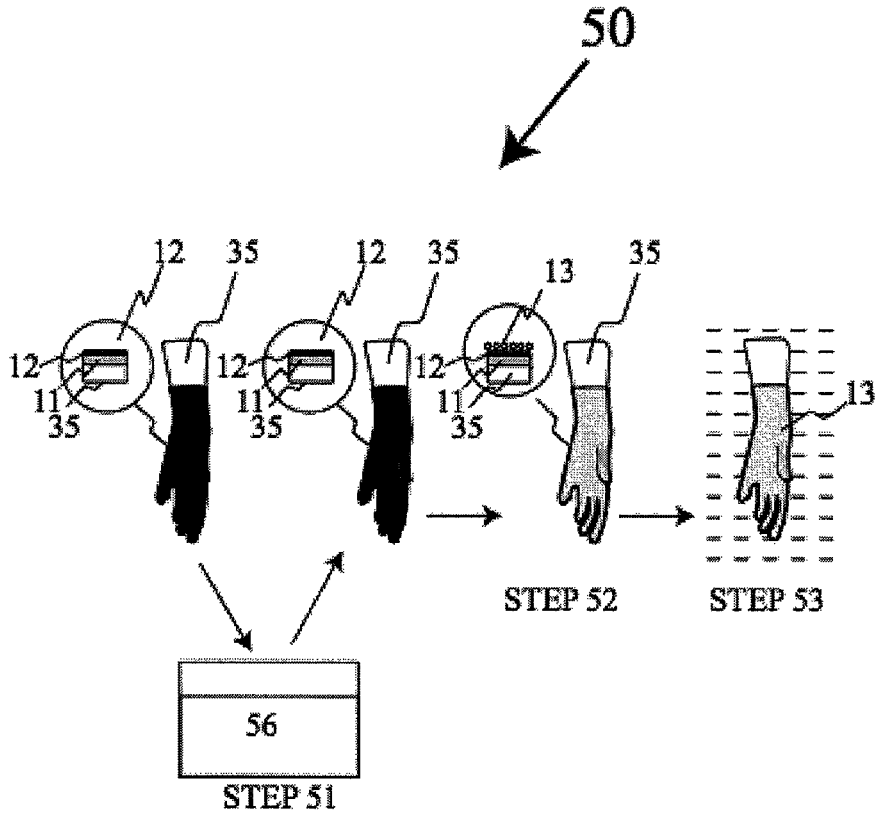
FIG. 5 illustrates the steps involved in dressing a cut resistant liner over the continuous tacky adhesive coating on the outer surface of the impervious chemical resistant nitrile or polychloroprene polymeric shell.

FIG. 5 schematically depicts at 50 the process steps involved in applying a cut resistant liner over the tacky adhesive coating of the polymeric latex shell. The liner can be woven, non-woven, or knitted. At step 51, the polymeric latex shell tacky adhesive coating is wetted with water, dilute SDBS (Sodium dodecylbenzenesulphonate) solution or a soap solution in a tank 56 to deactivate the tackiness of the tacky coating. At step 52, the cut resistant liner is slipped over the deactivated adhesive layer. The cut resistant liner is typically knitted with a 13 gauge or 15 gauge needle. Other gauges, such as 18 gauge having a denier of 221, can also be used. A 13 gauge needle uses a 420 denier yarn and can handle up to 840 denier yarn and a knitted liner typically has a thickness of 25 to 30 mils. A 15 gauge liner usually uses a 318 denier yarn with a corresponding smaller cut resistant liner thickness. A denier defined as number of grams of a 9000 meter yarn. The knitted liner may comprise cut resistant yarns including Kevlar™ (DuPont, Wilmington, Del.), Spectra™ (Honeywell, Morristown, N.J.), steel wire, and wrapped cut resistant yarns in combination with non-cut resistant yarns including cotton, rayon, nylon or polyester. It is preferred that the cut resistant liner comprises steel containing yarns since the plasticity and strain hardening effects of the steel fibers enables higher degree of bending when the knife contacts the latex glove article polymeric coated surface creating a crease in the glove side wall that resists the knife cutting force to a greater degree. The preferred cut resistant liner comprises 20 micron steel yarns knitted with a cotton carrier with a three dimensional knit patterns preferably tailored to match the anatomical shape of a human hand and fore arm as exemplified in U.S. Pat. Nos. 7,213,419 and 7,246,509. The cut resistant liner has a thickness in the range of 15 to 30 mils. If the lubricant used is a soap or detergent solution it is washed with water. In step 53, the tacky adhesive layer is dried restoring its tacky nature and securing the cut resistant liner against the tacky adhesive surface coated on the polymeric latex shell.

Figure 6:
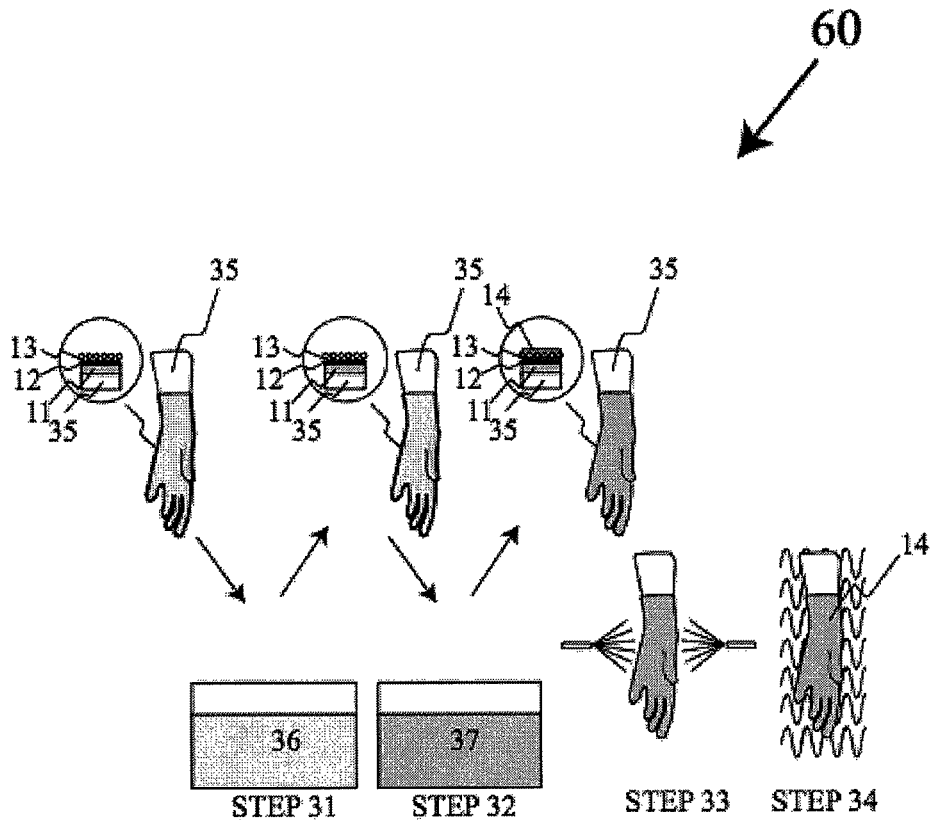
FIG. 6 illustrates the steps involved in encapsulating the cut resistant liner with a polymeric coating that integrally attaches the cut resistant liner with the polymeric coating.

FIG. 6 schematically depicts at 60 the process steps involved in applying a polymeric coating to the cut resistant liner affixed over the tacky adhesive coating of the polymeric latex shell. At step 61, the former with the latex polymeric shell with tacky adhesive coating and attached cut resistant liner is dipped into a coagulant solution such as a calcium nitrate solution. The coagulant penetrates the interstices of the cut resistant liner and does not penetrate the tacky adhesive coating. At step 62, the coagulant coated former assembly is dipped into an aqueous latex bath to coagulate a layer of polymeric coating that encases the cut resistant liner. The latex emulsion may be aqueous nitrile latex emulsion or aqueous polychloroprene latex emulsion. The latex film may extend beyond the thickness of the liner. At step 63, the polymeric coating is washed to remove processing chemicals. At step 64, the former assembly is heated to cure the polymeric coating. The latex film thus cured integrally attaches the cut resistant liner to the polymeric coating, enabling the combination to move together when a load is applied. The polymeric coating need not penetrate all the way through the cut resistant liner and is typically in the range of 15 to 35 mils. The polymeric coating does not penetrate or bond to the tacky adhesive coating.

Figure 7:
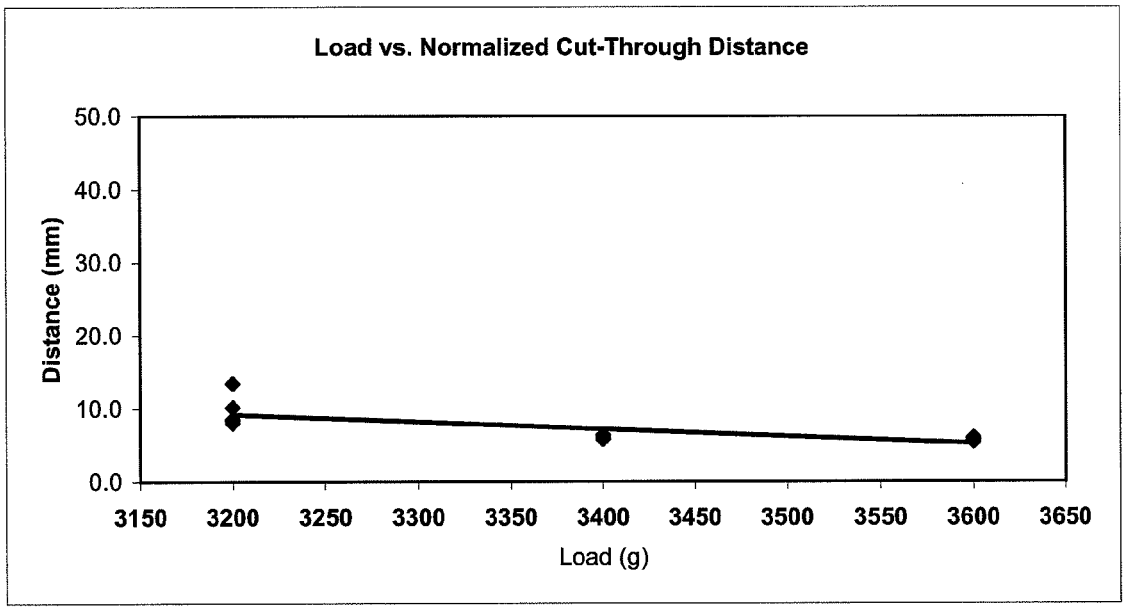
FIG. 7 illustrates the cut resistance performance of the cut resistant latex article when mounted on a non-compliant steel mandrel.

The performance of the cut resistant latex glove article was evaluated by cut resistance ASTM tests. A 4 inch long strip was cut from the cut resistant latex glove article and was mounted using a double sided tape securing the flock lined hand contacting side of the glove to a cylindrical steel mandrel with the axis of the cylinder oriented along the knife movement. The curvature of the mandrel prevented binding of the knife and the generation of frictional forces. A cutting blade was mounted on a rotatable arm and was loaded with a selected weight. The arm with the cutting blade was rotated exerting a cutting force on the cut resistant latex glove article strip on the polymeric coating surface. The knife progressively cut and eventually cut through the glove strip. The length of the cut was recorded. Next, the glove strip was displaced and the knife was loaded with an increased weight and the test was repeated. The plot in FIG. 7 shows the cut length as a function of the knife-selected load. Clearly, as the load increased, the cut length decreased since the knife readily cut through the glove strip. Since the glove strip was mounted on a non-compliant steel, the glove strip could not flex or bend under the knife edge and this cutting action more or less simulated a condition when the cut resistant liner is integrally held within a latex glove article with no slip surfaces.

Figure 8:
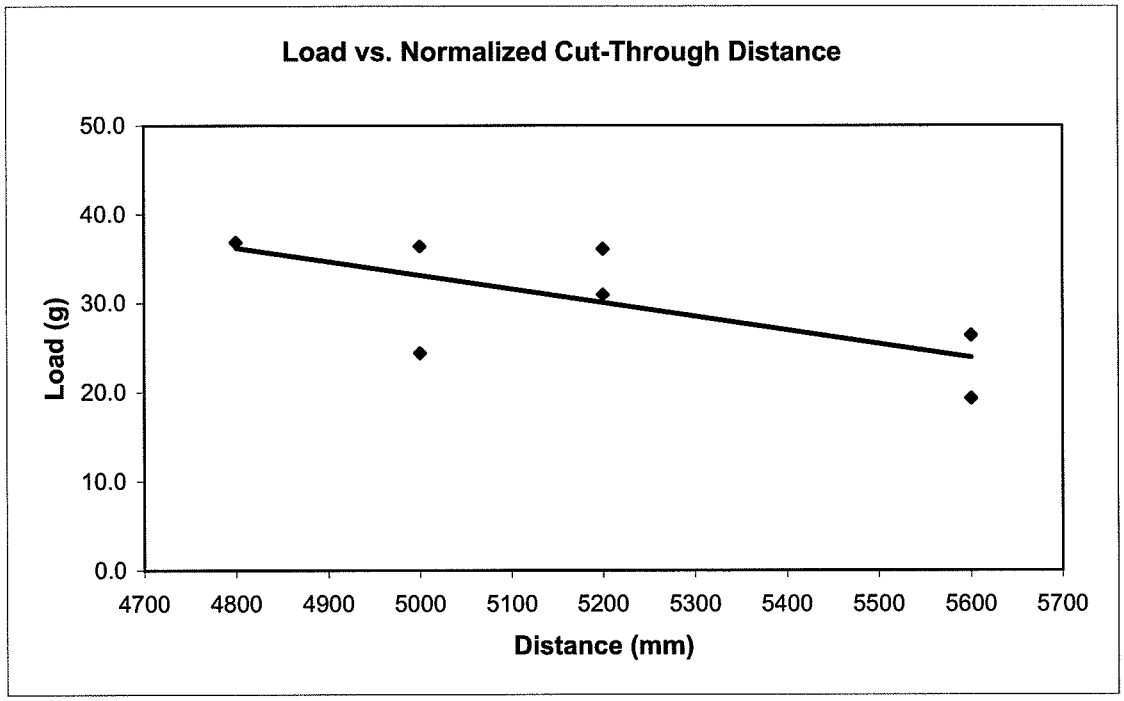
FIG. 8 illustrates the cut resistance performance of the cut resistant latex article when mounted on a compliant rubber pad that is attached to a steel mandrel.

FIG. 8 shows test results of cut resistant glove strip similar to that discussed in FIG. 7 except that a compliant rubber pad was inserted and held in place by two double-sided pieces of tape between the steel mandrel and the cut resistant latex glove strip. The loads needed to cut through the glove were significantly larger reflecting the cut resistance character of the glove that is provided due to the flexing of the cut resistant liner encased in the polymeric coating and the slippage at the interface between the cut resistant liner and the tacky adhesive coating. This presented a larger area of the cut resistant liner to the knife-edge and almost the full width of the cutting blade contacted the latex glove strip. In contrast, when only the steel mandrel was used without the compliant rubber pad only about ¼ of an inch of the blade contacted the latex glove strip. The cut generated with the rubber pad underneath was more ragged indicating that a larger volume of cut resistant liner participated in resisting the cutting action of the cutting blade. In contrast, the cut created with only the steel mandrel was sharp and a clean cut.

Accordingly, in view of the above, in one or more embodiments, the method can comprise the steps of:

a) providing a cured, liquid-impervious, nitrile or polychloroprene polymeric latex shell produced by dipping a coagulant-coated former into an aqueous latex emulsion, coagulating a latex layer on the former, and heating the coagulated latex layer on the former to crosslink and cure the latex layer;
b) washing the polymeric latex shell to remove surfactants used to dip process the shell;
c) applying a water-based acrylic tacky adhesive to the surface of the polymeric latex shell and air drying to establish the tacky coating;
d) wetting the tacky layer coated polymeric shell with water or soapy water to deactivate the tackiness and provide a lubricating surface;
e) dressing the adhesive tackiness deactivated polymeric latex shell with a cut resistant liner knitted in the shape of a human hand;
f) washing the wetted tacky layer using water immersion or water spray and drying in air flow to restore tackiness and affix the cut resistant liner on the tacky adhesive coating;
g) dipping the former assembly comprising former, polymeric latex shell, tacky adhesive coating and cut resistant liner in a coagulant solution such as calcium nitrate solution and the coagulant penetrating the interstices between yarns in the knitted cut resistant liner;
h) dipping the former assembly with coagulant coating in a nitrile or polychloroprene aqueous emulsion latex to form a coagulated latex layer that penetrates the interstices between yarns in the knitted cut resistant liner;
i) heating the former assembly to cure the coagulated latex and form a polymeric coating that integrally attaches the cut resistant liner to the polymeric coating;
j) cooling the former assembly producing a cut resistant chemical handling latex glove article that covers the hand and forearm of the user.

The hand contacting interior surface of the cut resistant chemical resistant latex glove article may be provided with a flock coating for sweat management ad improve user comfort. The polymeric coating may extend beyond the cut resistant liner and may be imparted with a grip enhancing texture such as that as disclosed in the U.S. Patent Application Publication No. 2005/0035493 to Flather et al.

All references, including publications, patent applications, and patents, cited herein are hereby incorporated by reference to the same extent as if each reference were individually and specifically indicated to be incorporated by reference and were set forth in its entirety herein.

The use of the terms "a," "an," "the," and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

It should be understood that the illustrated embodiments are exemplary only, and should not be taken as limiting the scope of the invention.

What is claimed is:

1. A cut-resistant chemical handling latex glove comprising:

(a) a cured, liquid-impervious polymeric latex shell, comprising a polymer, (b) a tacky adhesive coating, which is coated on the polymeric shell, and (c) a cut-resistant liner, wherein the liner is infiltrated with a polymeric coating, and wherein the liner is adjacent to the tacky adhesive coating and fibers of the liner are adhesively contacted with the adhesive, wherein the adhesion contact from the tacky adhesive coating (b) to the liner (c) has a shear strength permitting the tacky adhesive coating and liner to slip with respect to one another, whereby, when the glove is on a hand, pressing a cutting edge against the glove causes the tacky adhesive coating (b) to move sufficiently with respect to the liner and (c) to facilitate formation of an inward crease in a glove shape such that the cutting stress on the cut-resistant liner is less than would pertain if the adhesive contact from the tacky adhesive coating to the liner were non-slip.

2. The glove of claim 1, wherein the shell comprises a nitrile synthetic latex composition.

3. The glove of claim 1, wherein the shell comprises a polychloroprene synthetic latex composition.

4. The glove of claim 1, wherein said polymeric shell is adapted to cover both a hand and a forearm of a user.

5. The glove of claim 1, wherein the polymeric shell has a thickness in the range of 9 to 13 mil, the adhesive coating has a thickness of 1 to 5 mil, the cut-resistant liner has a thickness of 15 to 30 mil and the polymeric coating has a thickness in the range of 15 to 35 mil.

6. The glove of claim 1 having an overall thickness in the range of 50 to 75 mils.

7. The glove of claim 1, wherein said cut-resistant liner comprises one or more steel fibers.

8. The glove of claim 7, wherein said one or more steel fibers have a nominal size of 20 microns.

9. The glove of claim 1, further comprising an inner absorbent liner.

10. The glove of claim 1, wherein the cut-resistant liner is woven, non-woven, or knitted.

11. The glove of claim 1, wherein the integral cut-resistant liner further comprises a textured surface.

12. The cut-resistant chemical handling latex glove of claim 1 wherein the adhesive coating is a pressure-sensitive adhesive.

13. A cut-resistant chemical handling latex glove comprising:

(a) a cured, liquid-impervious polymeric latex shell, comprising a polymer, (b) a tacky adhesive coating, which is coated on the polymeric shell, and (c) a cut-resistant liner, wherein the liner is infiltrated with a polymeric coating, and wherein the liner is adjacent to the tacky adhesive coating and fibers of the liner are adhesively contacted with the adhesive, wherein the adhesion contact from the tacky adhesive coating (b) to the liner (c) has shear strength permitting the tacky adhesive coating and liner to slip with respect to one another.

14. A method for the manufacture of a cut-resistant chemical handling latex glove of claim 13, the method comprising forming a cured, liquid-impervious polymeric latex shell;

coating the polymeric shell with a tacky adhesive coating;

forming a lubricating surface by temporarily rendering the tacky adhesive coating not tacky;

placing a cut-resistant liner over the lubricating surface;

restoring tackiness to the lubricating surface to provide the tacky adhesive coating;

forming a cut-resistant liner by infiltrating the cut-resistant liner with a polymeric coating;

anchoring the integral cut-resistant linter to the tacky adhesive; and thereby forming the glove, which upon placing the glove on a hand and contacting a cutting edge on the glove, the integral cut-resistant liner slips on the tacky adhesive, thereby reducing cutting stress at the cutting edge.

15. The method of claim 14, wherein the tacky adhesive coating comprises a water-based acrylic.

16. The method of claim 14, wherein the step of forming the lubricating surface comprises wetting the tacky adhesive coating with water or soapy water to deactivate the tackiness.

17. The method of claim 14, wherein the step of restoring tackiness comprises washing the lubricating surface using water immersion or water spray and drying in air flow.

18. The method of claim 14, wherein the step of forming the integral cut-resistant liner comprises:

dipping the cut-resistant liner in a coagulant solution said coagulant penetrating the interstices of the cut-resistant liner;

dipping the coagulant-coated cut-resistant liner in a polymeric latex emulsion to form the coagulated polymeric coating; and curing and cooling the polymeric latex coating.

19. A method of providing improved hand safety, the method comprising:

donning a cut-resistant and chemical resistant latex glove of claim 13; and applying a loading from a cutting edge to the glove to permit the coated cut-resistant liner to slip on the tacky adhesive and thereby reduce cutting stress at the cutting edge.

20. The cut-resistant chemical handling latex glove of claim 13 wherein the adhesive coating is a pressure-sensitive adhesive.

* * * * *